US009527297B2

(12) United States Patent
Saikawa

(10) Patent No.: US 9,527,297 B2
(45) Date of Patent: Dec. 27, 2016

(54) LIQUID TANK AND INK EJECTION DEVICE

(71) Applicant: CANON KABUSHIKI KAISHA, Tokyo (JP)

(72) Inventor: Hideo Saikawa, Machida (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/830,439

(22) Filed: Aug. 19, 2015

(65) Prior Publication Data

US 2016/0059574 A1 Mar. 3, 2016

(30) Foreign Application Priority Data

Aug. 26, 2014 (JP) ..... 2014-171697

(51) Int. Cl.
*B41J 2/175* (2006.01)
*B41J 29/13* (2006.01)

(52) U.S. Cl.
CPC ..... *B41J 2/1752* (2013.01); *B41J 2/1753* (2013.01); *B41J 2/17546* (2013.01); *B41J 29/13* (2013.01); *B41J 2/17523* (2013.01); *B41J 2/17526* (2013.01)

(58) Field of Classification Search
None
See application file for complete search history.

(56) References Cited

U.S. PATENT DOCUMENTS

| | | | | |
|---|---|---|---|---|
| 7,213,914 | B2 | 5/2007 | Anma et al. | 347/86 |
| 7,841,711 | B2 | 11/2010 | Matsumoto et al. | 347/86 |
| 8,382,265 | B2 | 2/2013 | Matsumoto et al. | 347/86 |
| 8,454,141 | B2 | 6/2013 | Matsumoto et al. | 347/86 |
| 8,529,034 | B2 | 9/2013 | Matsumoto et al. | 347/86 |
| 8,596,770 | B2 | 12/2013 | Matsumoto et al. | 347/86 |
| 8,678,569 | B2 | 3/2014 | Matsumoto et al. | 347/86 |
| 8,678,570 | B2 | 3/2014 | Matsumoto et al. | 347/86 |
| 8,801,162 | B2 | 8/2014 | Matsumoto et al. | 347/86 |
| 2005/0219303 | A1 | 10/2005 | Matsumoto et al. | 347/19 |

(Continued)

FOREIGN PATENT DOCUMENTS

JP 2011-93328 5/2011

OTHER PUBLICATIONS

U.S. Appl. No. 14/830,434, filed Aug. 19, 2015; Inventor: Hideo Saikawa.

*Primary Examiner* — Lisa M Solomon
(74) *Attorney, Agent, or Firm* — Fitzpatrick, Cella, Harper & Scinto

(57) ABSTRACT

Notification is made to a user when mechanical engagement of an ink tank has been ensured such that the user does not stop a mounting operation before completion of mounting of the ink tank. A substrate includes a light emitting unit and a control unit configured to control the light emitting unit in accordance with a conduction state between an electrode and a corresponding electrode. A liquid tank is moved by force, a second engagement unit is locked to a second lock unit, and the liquid tank is mounted into a holder at a mounting completion position. In the movement, after the liquid tank has gone past the mounting completion position and a second engagement unit has shifted to a state of being partially engaged with the second lock unit, the electrodes shift from a non-conductive state to a conductive state.

12 Claims, 9 Drawing Sheets

(56) References Cited

U.S. PATENT DOCUMENTS

| | | | | |
|---|---|---|---|---|
| 2008/0049081 | A1* | 2/2008 | Hayashi | B41J 2/17513 347/86 |
| 2008/0204529 | A1 | 8/2008 | Matsumoto et al. | 347/86 |
| 2008/0259135 | A1* | 10/2008 | Asauchi | B41J 2/1752 347/84 |
| 2009/0128609 | A1 | 5/2009 | Matsumoto et al. | 347/86 |
| 2010/0208015 | A1 | 8/2010 | Matsumoto et al. | 347/86 |
| 2010/0302291 | A1 | 12/2010 | Matsumoto et al. | 347/6 |
| 2010/0309265 | A1 | 12/2010 | Matsumoto et al. | 347/86 |
| 2010/0309266 | A1 | 12/2010 | Matsumoto et al. | 347/86 |
| 2013/0208044 | A1 | 8/2013 | Matsumoto et al. | 347/19 |
| 2014/0320557 | A1 | 10/2014 | Matsumoto et al. | 347/5 |

* cited by examiner

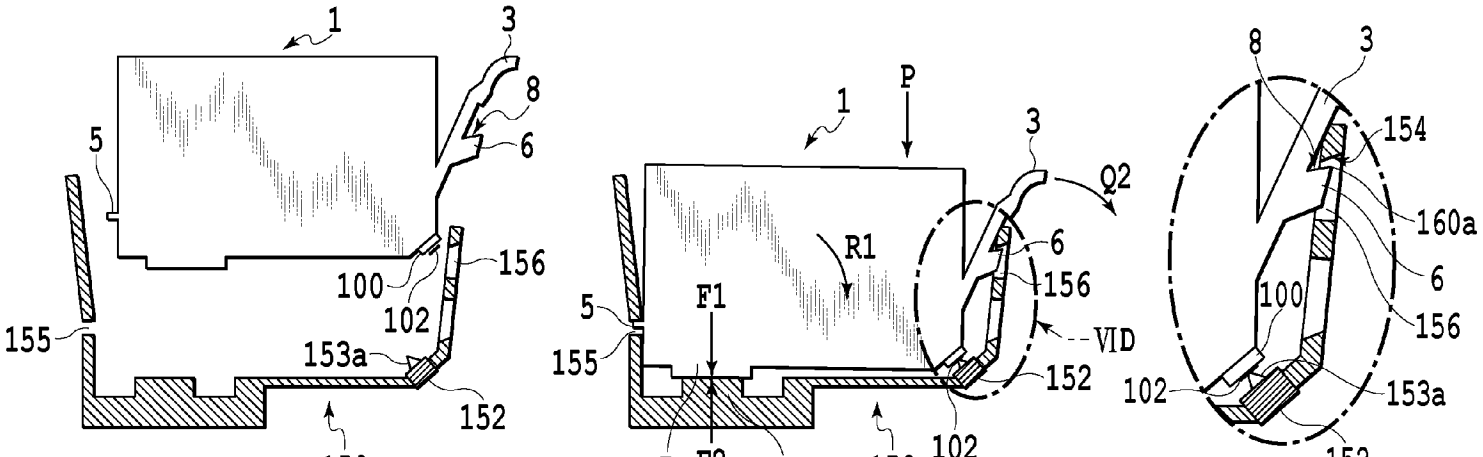
FIG.6A
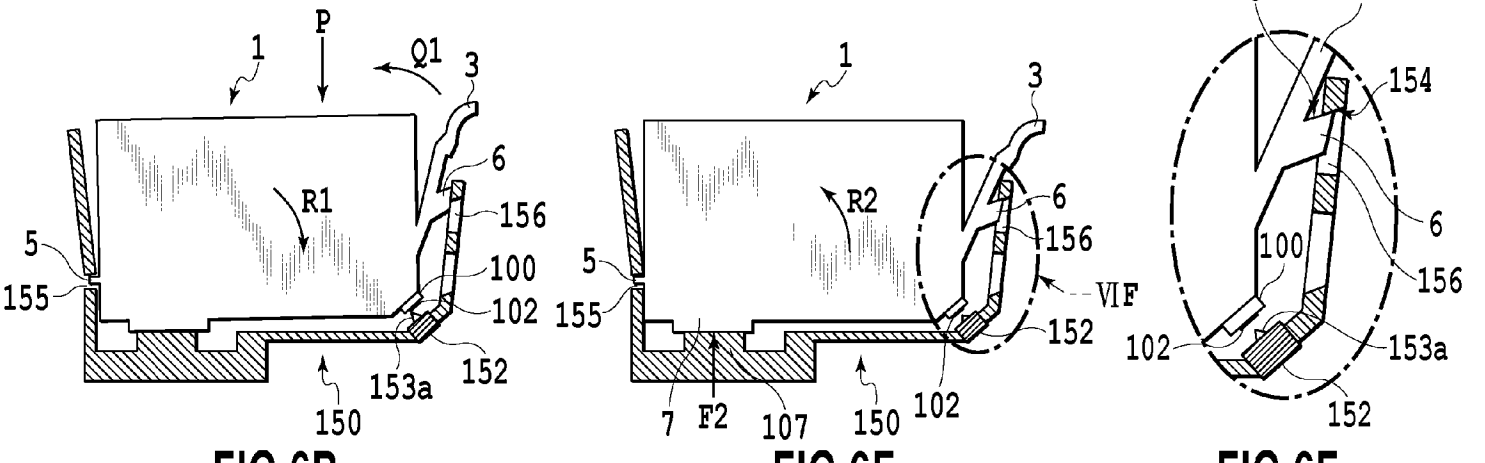
FIG.6B
FIG.6C
FIG.6E
FIG.6D
FIG.6F

LIQUID TANK AND INK EJECTION DEVICE

BACKGROUND OF THE INVENTION

Field of the Invention

The present invention generally relates to a liquid tank and a liquid ejection device. More specifically, the present invention relates to detection of a mounting state of the liquid tank, in the liquid tank in which a liquid is contained and the liquid ejection device capable of mounting the liquid tank thereon and configured to eject the liquid supplied from the liquid tank.

Description of the Related Art

As one example of a liquid ejection device, which is also referred to herein as a liquid ejection apparatus, there is an inkjet printing device. Replenishment of ink into the inkjet printing device is possible for a user by replacing a used ink tank with a new ink tank which contains ink. In general, the ink tank which is the liquid tank is configured to be attachable/detachable relative to a holder provided in the inkjet printing device or a holder provided in a carriage of the inkjet printing device.

In the inkjet printing device so configured, in ink tank replacement, the ink will not be supplied to a printing head unless the user correctly mounts the ink tank to a predetermined position of the holder. Accordingly, there is an inkjet printing device which is configured to inform the user of completion of mounting at a point of time that the ink tank has been correctly mounted so as to allow the user to confirm completion of mounting. As used herein, mounting of the ink tank to the holder is also referred to as attaching of the ink tank to the holder.

Japanese Patent Laid-Open No. 2011-93328 discloses provision of information as to whether mounting of the ink tank has been correctly accomplished and so on to the user and the inkjet printing device by emitting or not emitting light and/or by changing a light emitting state (blinking and so forth). In FIG. 7 in Japanese Patent Laid-Open No. 2011-93328, in the case where the user gradually pushes down an ink tank (1) in an arrow P direction, a second engagement unit (6) is engaged with a second lock unit (156) and the ink tank is mechanically set, and thereby an ink tank mounting operation is performed. In the case where the ink tank mounting operation is performed, an electrode (102) on the ink tank side is electrically connected to an electrode (152) on the carriage side of the inkjet printing device and thereby that the ink tank has been mounted is detected. A first light emitting unit (101) is controlled to emit light in response to the detection.

Owing to the above-mentioned configuration, since whether the ink tank mounting operation has been correctly performed is visually confirmed, a determination which is more accurate than a sensuous determination to be made relying on finger touch is made.

SUMMARY OF THE INVENTION

In a first aspect of the present invention, there is provided a liquid tank, including a structure to be mounted to a mounting unit which is included in a liquid ejection device and includes an introduction unit and a lock unit, and a first electrode, the structure including a supply unit to be coupled with the introduction unit and an engagement unit to be engaged with the lock unit, and the supply unit being coupled with the introduction unit at a mounting completion position where the engagement unit is engaged with the lock unit to supply a liquid which is contained therein from the supply unit to the liquid ejection device via the introduction unit, the liquid tank, comprising: an informing unit; and a control unit configured to control the informing unit in accordance with a conduction state between the first electrode and a second electrode that the mounting unit includes corresponding to the first electrode, wherein the liquid tank is configured such that the engagement unit is engaged with the lock unit by movement of the liquid tank relative to the mounting unit by force acting on a predetermined portion of the liquid tank, and the liquid tank is mounted on the mounting unit at the mounting completion position, and in the movement, after the liquid tank has gone past the mounting completion position and the engagement unit has come into a state of being partially engaged with the lock unit, the first and second electrodes shift from a non-conductive state to a conductive state.

In a second aspect of the present invention, there is provided a liquid tank, a liquid ejection device, comprising: a mounting unit configured to mount a liquid tank; and an ejection unit configured to eject a liquid supplied from the liquid tank via an introduction unit, the liquid tank, including a structure to be mounted to the mounting unit including the introduction unit and a lock unit, and a first electrode, the structure including a supply unit to be coupled with the introduction unit and an engagement unit to be engaged with the lock unit, and the supply unit being coupled with the introduction unit at a mounting completion position where the engagement unit is engaged with the lock unit to supply the liquid which is contained therein from the supply unit to the ejection unit via the introduction unit, the liquid tank, including: an informing unit; and a control unit configured to control the informing unit in accordance with a conduction state between the first electrode and a second electrode that the mounting unit includes corresponding to the first electrode, wherein the liquid tank is configured such that the engagement unit is engaged with the lock unit by movement of the liquid tank relative to the mounting unit by force acting on a predetermined portion of the liquid tank, and the liquid tank is mounted on the mounting unit at the mounting completion position, and in the movement, after the liquid tank has gone past the mounting completion position and the engagement unit has come into a state of being partially engaged with the lock unit, the first and second electrodes shift from a non-conductive state to a conductive state.

As used herein, the electrodes are also referred to as tank-side electrodes or apparatus-side electrodes, as appropriate; the mounting unit is also referred to as and attaching unit; the introduction unit is also referred to as an introducing portion; the lock unit is also referred to as a locking portion; the ejection unit is also referred to as an ejecting portion; the engagement unit is also referred to as an engaging portion; the supply unit to be coupled is also referred to as a supplying portion for joining; and mounting completion position is also referred to as an attachment completion position.

Further features of the present invention will become apparent from the following description of exemplary embodiments (with reference to the attached drawings).

BRIEF DESCRIPTION OF THE DRAWINGS

FIGS. 6A to 6F are schematic sectional diagrams for describing a process of mounting the ink tank according to the first embodiment into a holder illustrated in FIG. 2;

DESCRIPTION OF THE EMBODIMENTS

Figure 1:
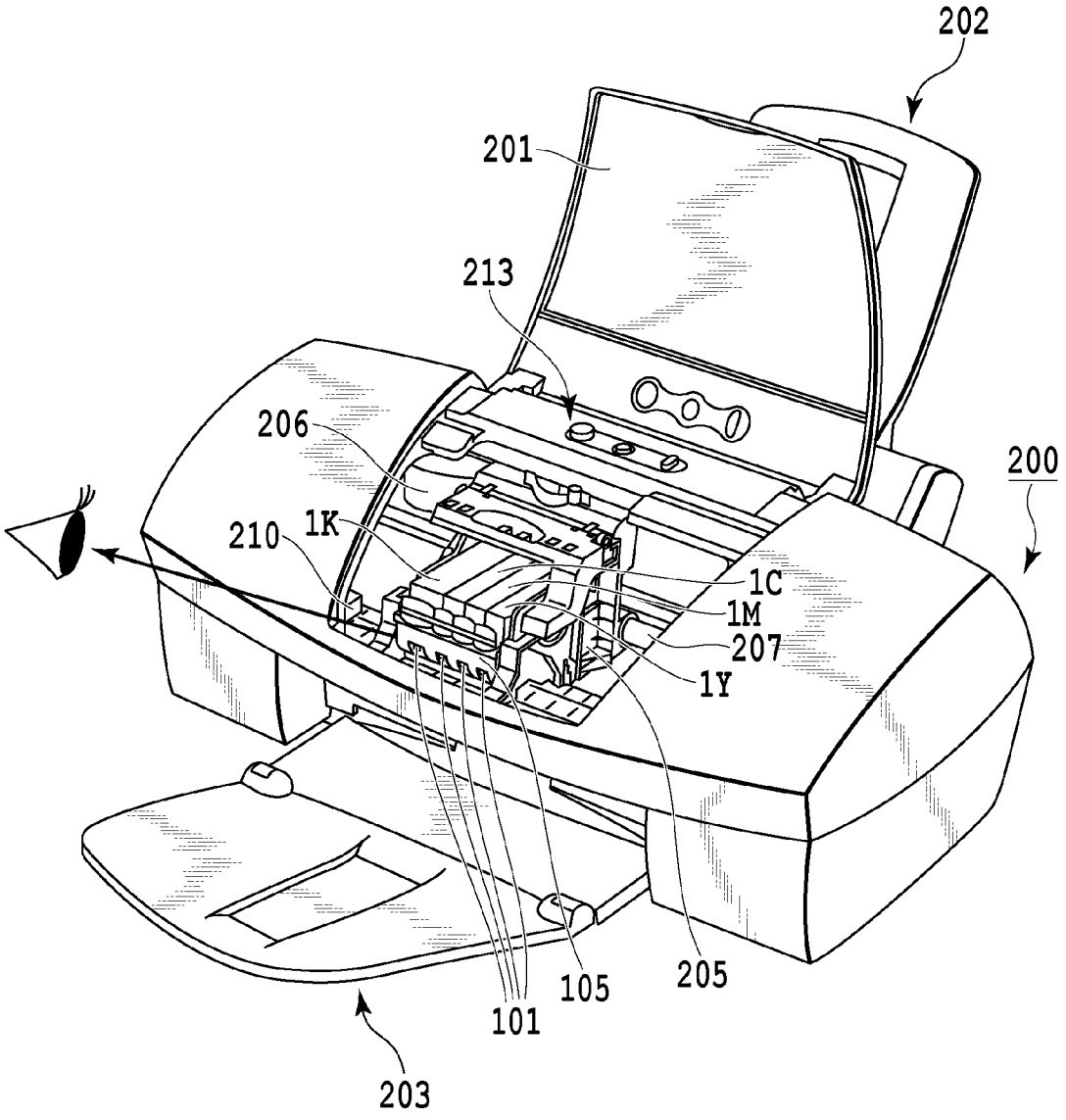
FIG. 1 is a perspective view illustrating an inkjet printing device according to a first embodiment of the present invention.

However, although it would be good if both of the electrodes are electrically connected simultaneously with engagement of the second engagement unit (6) of the ink tank with the second lock unit (156), in an actual product, it is difficult to mutually match timings of engagement and conduction due to dimensional variation of components which configure the product. Supposing that engagement has been performed earlier than conduction, the electrodes are not electrically connected when the ink tank (1) has been set into the holder (105), and therefore information on the ink tank (1) is not transmitted to the inkjet printing device. Accordingly, it is unavoidable to set conduction somewhat earlier than engagement and, in a general case, the electrodes (102) and (152) are electrically connected shortly before the second engagement unit (6) shifts to a state of being engaged with the second lock unit (156) and light emission which indicates mounting of the ink tank (1) is performed in response to conduction of the electrodes.

Here, assuming a case where the user who pushes down the ink tank comparatively slowly performs the mounting operation, there is a possibility that the user may stop the mounting operation directly after the user has confirmed light which has been emitted in response to conduction and before the second engagement unit (6) is engaged with the second lock unit (156). In this case, since the ink tank mounting operation is not yet completed, an amount of ink to be supplied from the ink tank (1) becomes insufficient and printing is not performed correctly.

The present invention has an object to provide a liquid tank capable of informing the user of information on completion of mounting of the liquid tank at a point of time that a state where it is sure that the liquid tank will be mounted has been established in the process of the liquid tank mounting operation, and a liquid ejection device capable of mounting the liquid tank thereon.

<First Embodiment>

(Description of Inkjet Printing Device)

FIG. 1 is an outside perspective view illustrating a state where a body cover 201 of an inkjet printing device 200 according to a first embodiment of the present invention has been opened.

As illustrated in FIG. 1, in the inkjet printing device 200 which is a liquid ejection device of the present embodiment, a carriage with an inkjet printing head and an ink tank 1 (a liquid tank) loaded reciprocally moves to perform printing. In addition to a main body of the inkjet printing device which is a main part of performing printing, a discharge tray 203 and an automatic sheet feeder (ASF) 202 which are respectively provided on its front and rear sides are included.

In a case where the user opens the body cover 201, the carriage 205 automatically moves to an almost central position (hereinafter, also referred to as an "tank replacement position") illustrated in FIG. 1. The user performs an operation of replacing each of ink tanks 1K, 1Y, 1M and 1C (in the following, in some cases, these ink tanks are designated by the same numeral "1") with new one at the tank replacement position.

The inkjet printing device according to the present embodiment is of a type that an inkjet printing head 105 equipped with an ejection unit (not illustrated) is included and the ejection unit ejects ink to a printing medium such as a sheet by reciprocal movement of the carriage 205 and thereby printing is performed. Then, in the inkjet printing heads respectively corresponding to the inks of colors K, Y, M and C, ink ejection is performed on the basis of ejection data. The inkjet printing head makes a scan by the movement, ejects the ink to the printing medium and performs printing thereon.

The carriage 205 includes the inkjet printing head 105 which integrally includes the almost cuboid ink tank and a holder. On the other hand, each of the ink tanks 1 is attachably/detachably mounted to each of the inkjet printing heads 105.

(Description of Inkjet Printing Head)

Figure 2:
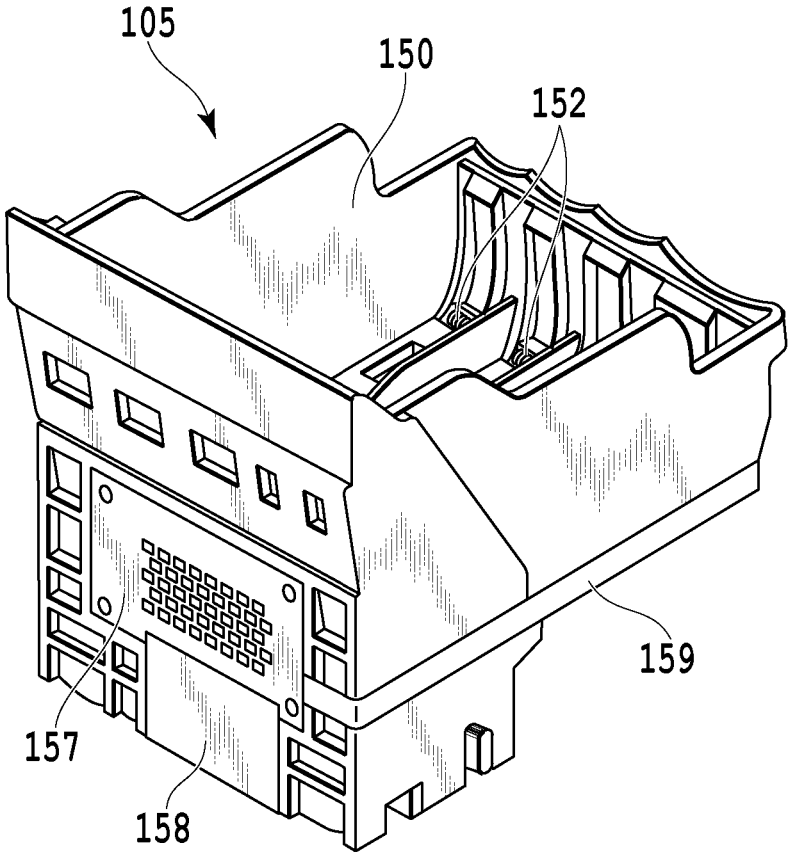
FIG. 2 is a perspective view illustrating an inkjet printing head to be loaded on the inkjet printing device illustrated in FIG. 1 and configured so as to freely attach and detach an ink tank according to the present embodiment to and from the inkjet printing device.

FIG. 2 is a perspective view illustrating the inkjet printing head in the present embodiment configured such that the ink tank is made attachable/detachable relative to the ink jet printing head. The inkjet printing head 105 generally includes the holder 150 configured to attachably/detachably hold the plurality of ink tanks and the ejection unit (not illustrated) arranged on the bottom surface side. Then, an ink introduction port (a liquid introduction unit) on the inkjet printing head side located on the holder bottom and an ink supply port (a liquid supply unit), that is described later, on the ink tank side are coupled together by mounting the ink tank which contains ink into the holder 150 and thereby an ink communication path is formed between both ports.

In the ejection unit, a heat generation resistance element is provided in a liquid path which configures a nozzle, thermal energy is imparted to the ink by giving a pulse signal to the heat generation resistance element and the ink is ejected with foaming energy which is generated in the ink with the thermal energy imparted. Then, contact of an electric contact part (not illustrated) for signal transfer provided on the carriage 205 with an electric contact part 157 on the inkjet printing head 105 side is established and a print signal is transferred to a heat generation resistance element drive circuit of the ejection unit via a wiring unit 158.

The inkjet printing head 105 which includes a tank holder unit configured to contain each ink tank 1 includes a connector 152 corresponding to each ink tank. Each of the connectors 152 comes into contact with a pad on a substrate provided facing the ink tank 1 to be mounted and is electrically connected with the pad. In addition, a wiring unit 159 leading to the connector 152 is also extended from the electric contact part 157.

Figure 3A:
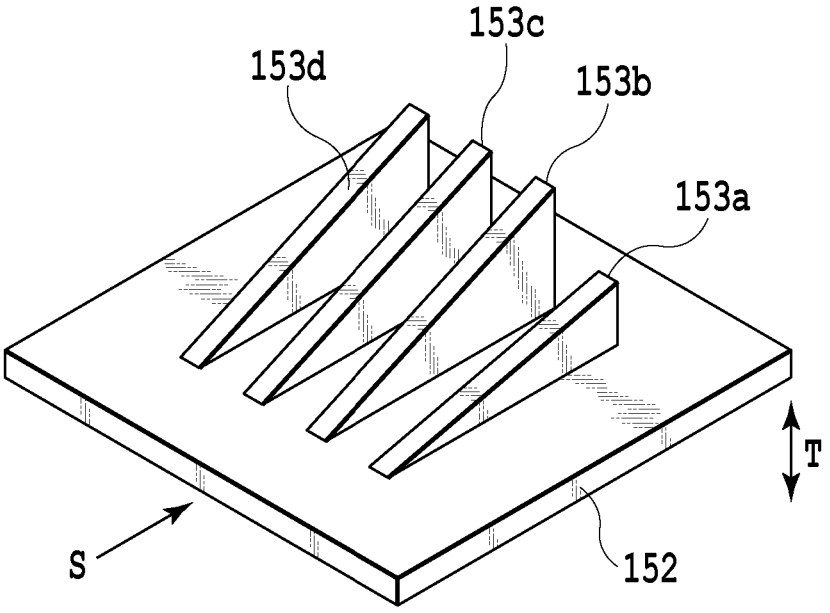
FIGS. 3A and 3B are diagrams illustrating a configuration of main parts of a holder that the inkjet printing head illustrated in FIG. 2 includes.
Figure 3B:
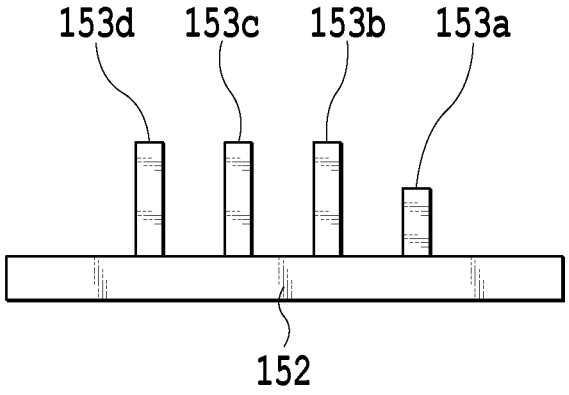

Here, FIG. 3A is an enlarged perspective view of the connector 152 and FIG. 3B is a schematic diagram illustrating the connector 152 viewed in an arrow S direction in FIG. 3A.

Pins 153*a* to 153*d* are made of a conductive material. Each of the pins 153*a* to 153*d* is configured to reversibly deform in an arrow T direction in a case of pressing its tip part and to restore to its original form in a case of releasing pressing force. The pin 153*a* is a pin which serves to detect the mounting state of the ink tank 1 into the holder 150. Each of the pins 153*b* to 153*d* is a pin which serves to transmit relevant information such as an ink residual amount of the ink tank 1 and/or serves to supply power. Here, the pins 153*b* to 153*d* are made longer than the pin 153*a*.

(Description on Tanks)

Figure 4A:
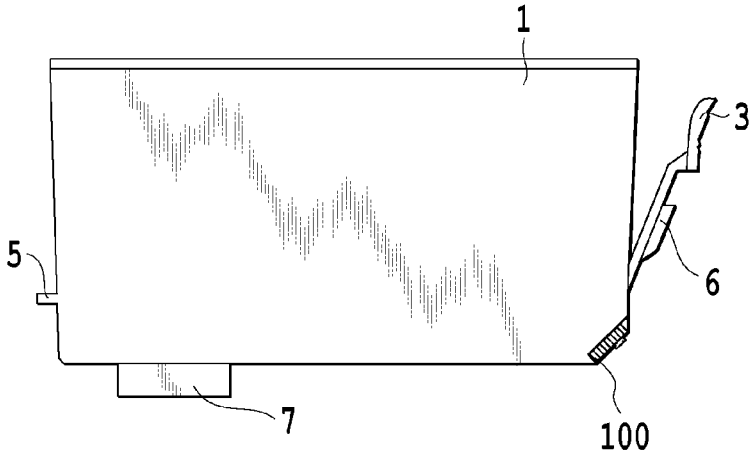
FIG. 4A is a diagram illustrating one surface of the ink tank to be mounted onto the inkjet printing device illustrated in FIG. 1.
Figure 4B:
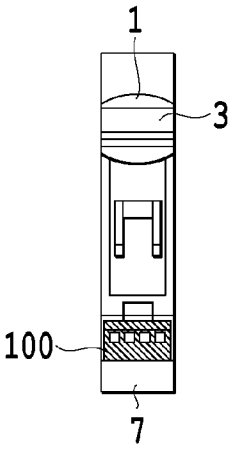
FIG. 4B is a diagram illustrating another surface of the ink tank to be mounted onto the inkjet printing device illustrated in FIG. 1.
Figure 4C:
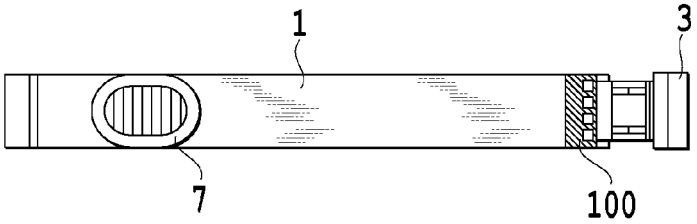
FIG. 4C is a diagram illustrating further another surface of the ink tank to be mounted onto the inkjet printing device illustrated in FIG. 1.

FIGS. 4A, 4B and 4C are respectively a side view, a front view and a bottom view of the ink tank according to the present embodiment. Incidentally, in the present description, a front surface of the ink tank indicates a surface where the user performs ink tank attaching/detaching operations and the user looks at light emitted from a later described LED (light emitting diode) element.

The ink tank 1 according to the present embodiment includes a support member 3 which is supported by a lower part on the front surface side. The support member 3 is formed with resin into a bar like shape integrally with an outer case of the ink tank 1. As used herein, the bar-shaped member is also referred to as a rod-like member. The support member 3 is configured to be displaceable around a supported part in a case of performing the later described operation of mounting the ink tank 1 into the holder, and so on. A first engagement unit 5 and a second engagement unit 6 (in the present example, integrated with the support member 3) respectively formed to be engageable with lock units on the holder side are provided on the back surface side of the ink tank 1 and on the front surface side opposite to the back surface side. A state of mounting the ink tank 1 into the holder 150 is ensured by engaging the first and second engagement units with the lock units of the holder 150. An operation performed in mounting the ink tank 1 will be described later with reference to FIGS. 6A to 6F.

An ink supply port 7 configured to perform ink supply by coupling with the ink introduction port in the inkjet printing head 105 in a case of mounting the ink tank 1 into the holder 150 is formed in the bottom surface of the ink tank 1. A substrate 100 is provided on the bottom surface side of a portion where the bottom surface and the front surface mutually join, that is, a portion which supports the support member 3.

Figure 5A:
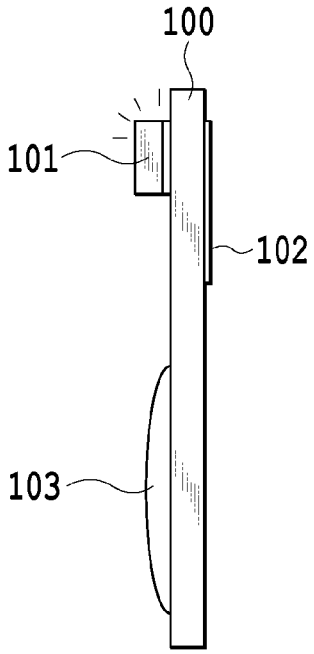
FIG. 5A is a diagram illustrating one surface of a substrate that the ink tank illustrated in FIGS. 4A to 4C includes.
Figure 5B:
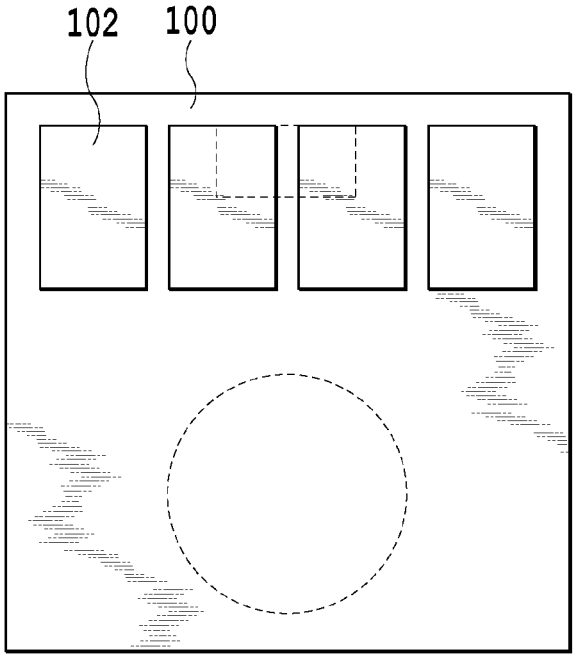
FIG. 5B is a diagram illustrating another surface of the substrate that the ink tank illustrated in FIGS. 4A to 4C includes.

Here, FIGS. 5A and 5B each illustrate the substrate 100 which is in a state of having been detached from the ink tank 1. FIG. 5A is a diagram of the substrate 100 viewed from its side surface and FIG. 5B is a diagram of the substrate 100 viewed from the holder side. A light emitting unit 101 such as the LED which emits visible light and a control unit 103 are provided on a surface of the substrate 100 located facing the inside of the ink tank 1.

The control unit 103 detects that the ink tank 1 has been correctly mounted in accordance with conduction between the pin 153*a* and a pad 102 which faces the pin 153*a* in a case where the user has performed the ink tank mounting operation as described later at the tank replacement position which has been described with reference to FIG. 1 and makes the light emitting unit 101 emit light.

The control unit 103 further controls to transmit various pieces of information on the ink tank 1 to the device main body side via another pin which is electrically connected with the pad 102 and a flexible cable 206 (FIG. 1). These pieces of information include information on adequacy of the type of the ink tank mounted, the ink residual amount and so on and a control circuit on the device main body side which has received these pieces of information controls so as to display these pieces of information on a display unit as required.

Apart from this, such a configuration is also possible that in a case where the pin 153*a* and the pad 102 are electrically connected, the control circuit on the device main body side transmits a control signal to the control unit 103 via the pin 153*a* and the pad 102 and the control unit 103 controls the light emitting unit 101 so as to emit light.

(Description on Ink Tank Mounting Process)

FIGS. 6A to 6F are diagrams illustrating a series of motions in a case of mounting the ink tank 1 into the holder 150 of the inkjet printing head 105. Main parts of the FIGS. 6C and 6E are enlarged and illustrated as FIGS. 6D and 6F. In the FIGS. 6D and 6F, an engagement state and a conduction state between the pad 102 and the pin 153*a* are illustrated. Table 1 indicates a correspondence relation among the engagement state, the conduction state and light emission of the LED in FIGS. 6B, 6C and 6E.

TABLE 1

| | | Conduction State | | |
|---|---|---|---|---|
| Explanatory Diagrams | Engagement State of Ink Tank with Holder | Pin 153a (for Mounting Detection) | Pins 153b, c, d (for Information Transfer) | Light Emission Of LED |
| FIG. 6B | Not Yet Engaged | Non-Conductive | Conductive | Not Yet Light Emitted |
| FIG. 6C | | Conductive | | Light Emitted |
| FIG. 6E | Engaged (Mounting Completed) | Non-Conductive | | |

In a case of mounting the ink tank 1 into the holder 150 of the inkjet printing head 105, as illustrated in FIG. 6A, the ink tank 1 is arranged above the holder 150. Then, the states indicated in Table 1 will be described with reference to FIGS. 6A to 6E to FIG. 8.

Next, as illustrated in FIG. 6B, the ink tank 1 is placed on the holder bottom surface in a state where the projection-shaped first engagement unit 5 provided on the back surface side of the ink tank 1 has been inserted through a through-hole-shaped first lock unit 155 provided on the back surface side of the holder 150. In a case of pushing down a front surface side upper portion of the ink tank 1 from this state as indicated by the arrow P, the ink tank 1 rotates in a rotation direction indicated by an arrow $R_1$ by using an engaged portion between the first engagement unit 5 and the first lock unit 155 as a fulcrum and gradually displaces downward in FIG. 6B. In this process, a side surface of the projection-shaped second engagement unit 6 provided on the support member 3 of the ink tank 1 abuts on an upper portion of a second lock unit 156 provided on the front surface side of the holder 150 and the support member 3 deforms in an arrow $Q_1$ direction while being pushed and approaches the front surface of the ink tank 1. In this state, although the pad 102 provided on the substrate 100 and the pin 153*a* of the connector 152 are not yet electrically connected, the pad 102 and the pins 153*b* to 153*d* (not illustrated) of the connector 152 are electrically connected.

Incidentally, in the process of the mounting operation illustrated in FIGS. 6B to 6F, comparing to operation of a "lever", the engaged portion between the first engagement unit 5 and the first lock unit 155 serves as the fulcrum and the front surface side of the ink tank 1 serves as a point of effort (the portion indicated by the arrow P). A coupled portion between the ink supply port 7 and an ink introduction port 107 serves as a point of action. The point of action is located between the point of effort and the fulcrum, preferably, near the fulcrum. Accordingly, it becomes possible for the ink supply port 7 to couple with the ink introduction port 107 by being pressed against the ink introduction port 107 by large force with rotation of the ink tank 1. As a structure of the coupled portion between both ports, generally, a comparatively flexible elastic member such as a filter, an absorber, packing and so on is used for the purpose of ensuring ink communicability and preventing ink leakage.

Further, in a case of pushing down the ink tank 1 in the arrow P direction, the ink tank 1 further rotates in the rotation direction R1 and shifts to the state in FIGS. 6C and 6D. That is, the second engagement unit 6 enters an opening in the second lock unit 156 and displaces the support member 3 in an arrow Q2 direction. An engagement surface 8 of the second lock unit 6 moves to a place under a lock surface 154 of the second lock unit 156. Thereby, the second lock unit 156 no longer pushes the side surface of the second engagement unit 6. Incidentally, the lock surface 154 is one surface which defines an opening in the second lock unit 156. Here, the orientation of the engagement surface 8 has an angle relative to the orientation of a movement locus of the second engagement unit 6. As used herein, the locus is also referred to as a trace. Therefore, in a case where the second engagement unit 6 moves to the place under the second lock unit 156, the ink tank 1 once goes past the final mounting completion position. The ink tank 1 overshoots up to a position where the ink tank 1 has been pushed most downwards in the arrow P direction, that is, the most remote end position in a rotatable range in this way. In this state, the engagement face 8 and the lock surface 154 are not in contact with each other and a position (FIGS. 6E and 6F) obtained in a case where the engagement face 8 and the lock surface 154 have shifted to the contact state is the final mounting completion position. In contrast, the state in FIGS. 6C and 6D may be also called a state where the engagement surface 8 is partially engaged with the lock surface 154. It is possible to extend the partially engaged state back to a point of time that at least part of the second engagement unit 6 has entered the opening in the second lock unit 156. A situation where the ink tank 1 overshoots will be described later in more detail.

In addition, a space between the pad 102 and the connector 152 becomes the shortest in this state. The pad 102 and the pins 153*b* to 153*d* (not illustrated) are still in the conductive state. The pad 102 and the pin 153*a* are electrically connected. The ink tank 1 and the tank holder 150, that include the pin 153*a*, the second engagement unit 6 and the second lock unit 156, are totally configured such that a timing at which the pad 102 and the pin 153*a* are electrically connected comes in a time period until the ink tank 1 shifts to the most pushed-in state after the second engagement unit 6 has gone past the final mounting completion position. More preferably, it is preferable that the timing comes directly after the second engagement unit 6 has gone past the final mounting completion position. After the second engagement unit 6 has gone past the final mounting completion position, it is sure that the ink tank will finally come to be mechanically mounted even in a case where pressing force in the arrow P direction is eliminated. This is because it is preferable to inform the user of the fact that the pad 102 and the pin 153*a* have shifted to the conductive state as early as possible. The control unit 103 makes the light emitting unit 101 (FIG. 5A) provided on the substrate 100 emit light owing to conduction of the pin 153*a*. In this occasion, the control unit 103 performs control so as to continue light emission or to keep light emitted exceeding a predetermined period of time still in a case of shifting again to the non-conductive state, after the pad 102 and the pin 153*a* have once shifted from the non-conductive state to the conductive state.

Figure 7:
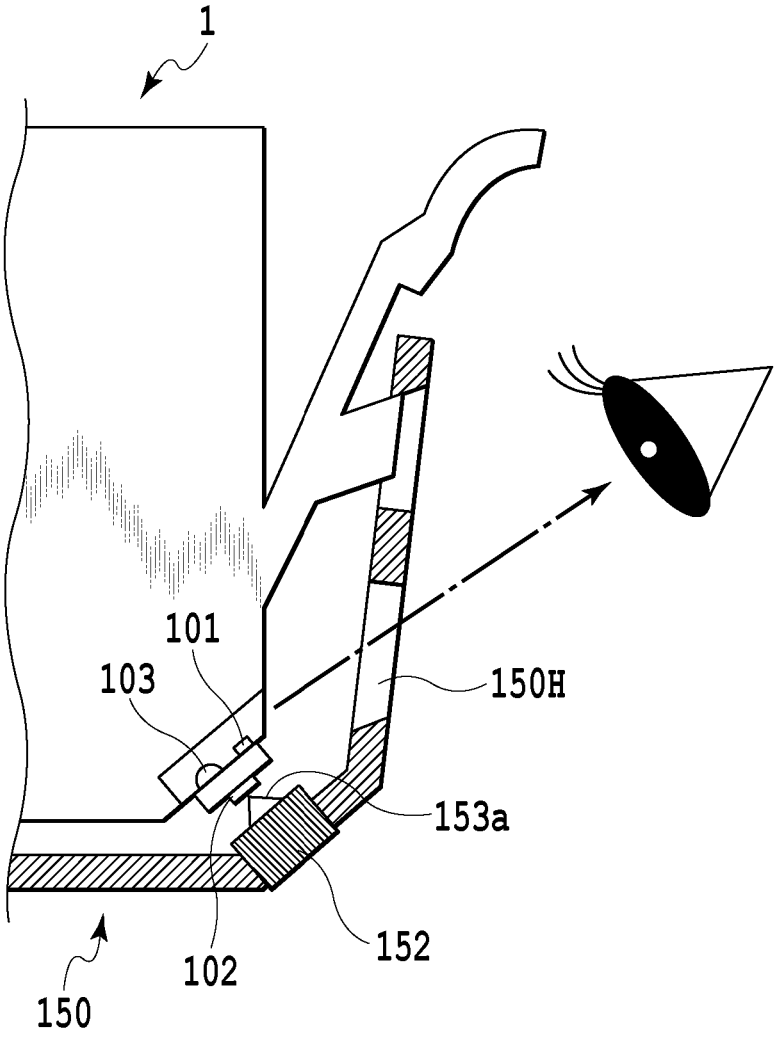
FIG. 7 is a schematic sectional diagram for describing a situation where a light emitting unit on the substrate that the ink tank includes emits light in the process of mounting the ink tank described in FIGS. 6A to 6F.

Here, light emission will be described using FIG. 7. FIG. 7 is a schematic side view for describing the outline of the function of the substrate to be arranged on the ink tank.

Light emitted from the light emitting unit 101 reaches the field of vision of the user passing through an opening 150H formed in the holder 150. It becomes possible to present information indicating that the ink tank 1 has been brought into a state of being surely mounted directly to the user with light emitted from the light emitting unit 101 in this way. That is, as illustrated in FIG. 7, it is possible for the user to confirm that the ink tank 1 will be surely mounted by visually observing the light emitting state of the light emitting unit 101 which has been controlled by the control unit 103. Control to be performed in order to indicate that the ink tank 1 has been brought into the state of being surely mounted is not limited to simply making the light emitting unit 101 emit light and control to make the light emitting unit 101 blink light and so on may be performed.

Here, returning to FIGS. 6A to 6F, a situation where mounting at the predetermined mounting position is finally completed will be described.

In the state in FIGS. 6C and 6D, force $F_1$ exerted in accordance with the pressing force in the arrow P direction acts from the ink supply port 7 onto the ink introduction port 107 and force $F_2$ acts from the ink introduction port 107 onto the ink supply port 7 as a reaction to the force $F_1$. The moment that the user has stopped pushing the ink tank 1 in the arrow P direction by looking at the light emitted from the light emitting unit 101, the force $F_2$ actuates to rotate the ink tank 1 in a reverse direction indicated by an arrow $R_2$ as illustrated in FIGS. 6E and 6F. Therefore, the engagement surface 8 of the second engagement unit 6 comes into a state of abutting on the lock surface 154 of the second lock unit 156. At that time, the second engagement unit 6 is locked by the second lock unit 156 at the final mounting completion position and mounting of the ink tank 1 is completed.

In this state, the pad 102 and the pins 153*b* to 153*d* (not illustrated) of the connector 152 are still in the conductive state. As described before, the pad 102 and the pin 153*a* are configured so as to shift from the non-conductive state to the conductive state in the period of time until the ink tank 1 is brought into the most pushed-in state in the arrow P direction after the second engagement unit 6 has gone past the final mounting completion position. Consequently, the pad 102 and the pin 153*a* shift from the conductive state to the non-conductive state in the time period that the ink tank 1 shifts from the state in FIGS. 6C and 6D to the state FIGS. 6E and 6F and again shift to the non-conductive state in the state in FIGS. 6E and 6F where the ink tank 1 has been fixed to the final mounting completion position.

Figure 8:
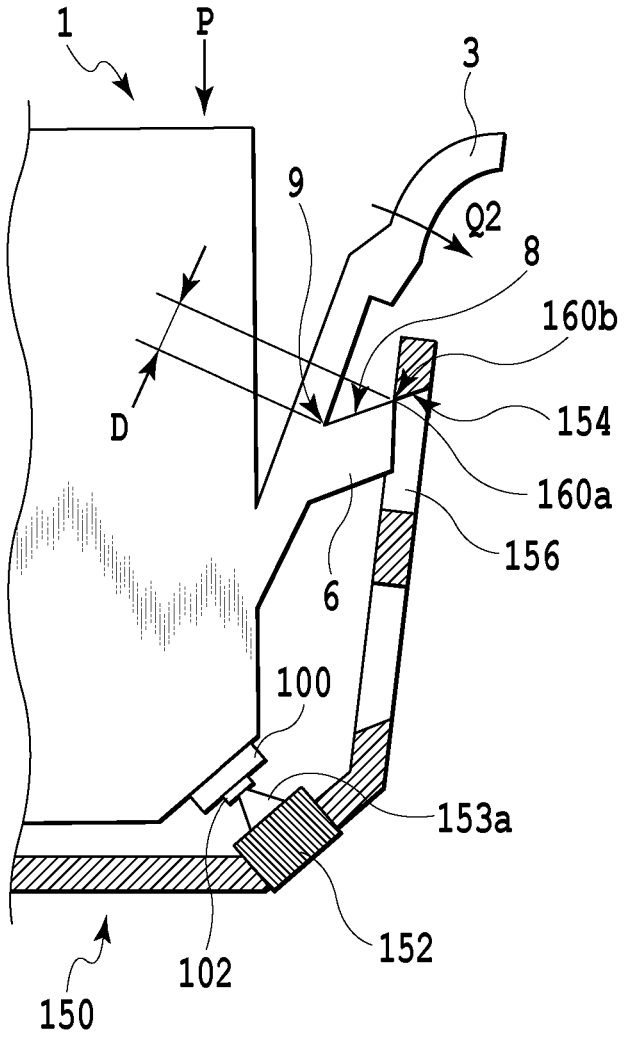
FIG. 8 is a schematic sectional diagram for describing in detail an operation in the process of mounting the ink tank illustrated in FIGS. 6A to 6F.

FIG. 8 is a schematic diagram illustrating the engagement unit and its surroundings for describing a situation that the engagement unit is engaged with the lock unit by overshooting of the ink tank 1 in a case of mounting the ink tank 1 into the holder 150.

Although the side surface of the second engagement unit 5 of the ink tank 1 abuts on the second lock unit 156 and the engagement face 8 is not yet in contact with the lock face 154 in the state in FIG. 6B, the ink tank 1 shifts to the state in FIG. 8 by further pushing down the ink tank 1 in the arrow P direction in this state. That is, a corner portion 160*a* of the second engagement unit 6 matches a corner portion 160*b* of the second lock unit 156. In this occasion, since force which aids the deformed support member 3 to return to its original shape acts in an arrow $Q_2$ direction, the support member 3 reversely deforms in the arrow $Q_2$ direction. Thereby, part of the second engagement unit 6 enters the opening in the second lock unit 156 and the state in FIGS. 6C and 6D is established.

Here, sine the engagement surface 8 and the lock surface 154 have the angle relative to the arrow $Q_2$ direction which is the movement locus of the support member 3, a space D is generated. In a case where the user stops pushing the ink tank 1 in the arrow P direction, the ink tank 1 displaces upward by the amount of the space D by force of repulsion of the ink introduction port 107 as described before, and the engagement surface 8 and the lock surface 154 shift to the final engaged state. In the present embodiment, the ink tank 1 is configured to once overshoot by the amount of the space D.

According to the present embodiment so configured, the electrode which serves to detect that the ink tank has been mounted into the holder becomes conductive after the state where it is sure that the ink tank will be mechanically mounted into the holder has been established. The ink tank is configured such that, in this occasion, the light emitting unit loaded on the ink tank emits light in accordance with conduction of the electrode. Therefore, the state where it is sure that the ink tank will be mechanically mounted into the holder is established in a case where the user has recognized light emission, it is possible to prevent the user from stopping the mounting operation hastily in a state where mounting of the ink tank 1 into the holder is not yet sure, regardless of how slowly the user performs the mounting operation. Consequently, it is possible to more improve reliability of liquid tank mounting.

Incidentally, the configuration of controlling the light emitting unit is not limited to the above-mentioned configuration. The control circuit on the device main body side may detect that the ink tank has been correctly mounted in accordance with conduction of the electrode which serves to detect that the ink tank has been mounted into the holder in a case where the user has performed the ink tank mounting operation and may control a light emitting unit provided on the device main body side. Further, in place of controlling the light emitting unit and/or additionally, control may be performed so as to make a display on a display unit provided on the device main body side. Further, it is also possible to perform control to generate an alarm sound such as an electronic sound and to perform control to generate vibration from a vibrator.

<Second Embodiment>

In the first embodiment, a time difference between conduction of the mating electrodes which serve to detect that the ink tank has been mounted into the holder and conduction of the mating electrodes which serve to play other roles has been generated depending on a difference in length among the pins provided on the connector. In the present embodiment, the time difference is generated by a configuration which is different from the above and is illustrated in FIGS. 9A to 9D.

Figure 9A:
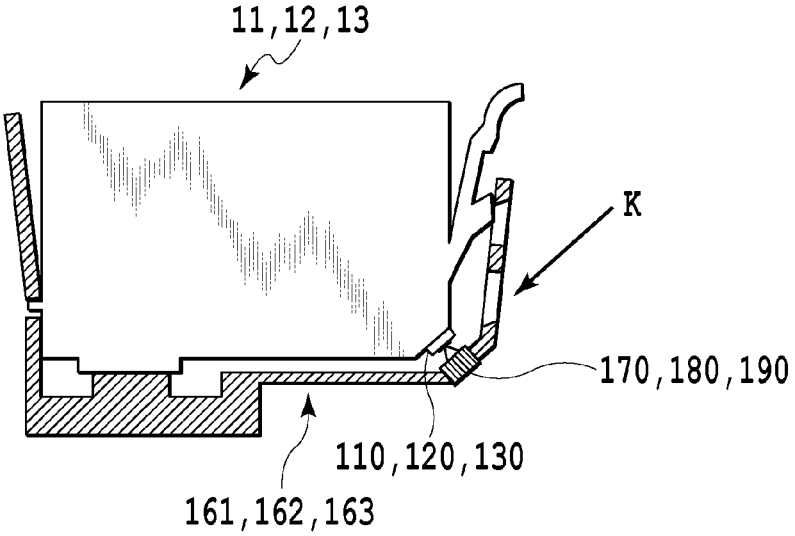
FIGS. 9A to 9D are schematic sectional diagrams illustrating a configuration of main parts according to a second embodiment of the present invention.

FIG. 9A is a schematic diagram illustrating a situation of mounting ink tanks 11, 12 and 13 respectively into holders 161, 162 and 163 of an inkjet printing head (not illustrated). Here, the timing at which an engagement unit of each of the ink tanks 11, 12 and 13 is engaged with a lock unit of each of the holders 161, 162 and 163, and so on are as described in the first embodiment.

Figure 9B:
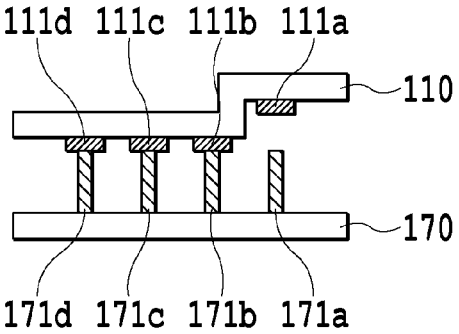
Figure 9C:
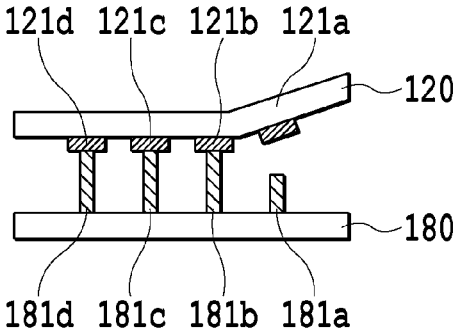
Figure 9D:
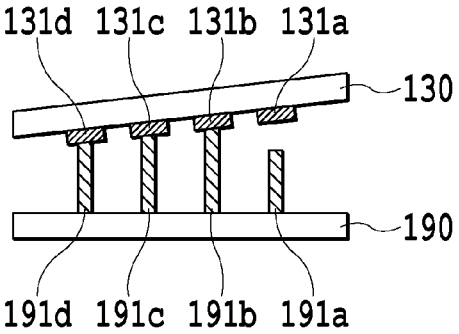

In addition, FIGS. 9B, 9C and 9D are schematic diagrams each illustrating a situation of viewing each of substrates 110, 120 and 130 and each of connectors 170, 180 and 190 from an arrow K direction in FIG. 9A. The substrates 110, 120 and 130 each include a light emitting unit (not illustrated) such as the LED which generates visible light and a control unit (not illustrated) which performs control and so on of the light emitting unit. Then, the control unit controls light emission from the light emitting unit in accordance with the conduction state between each of the connectors 170, 180 and 190 and a pad on each of the substrates 110, 120 and 130.

Describing in detail, FIG. 9B illustrates the substrate 110 and the connector 170 which are in the same mounting process as that of the state in FIGS. 6E and 6F of the first embodiment. The substrate 110 includes pads 111*a* to 111*d* provided thereon. The pad 111*a* serves to inform the user that the ink tank 11 has been mounted into the holder 161. The pads 111*b* to 111*d* serve to transmit various kinds of information such as the ink residual amount in the ink tank 11. The substrate 110 is bent into a crank shape and the pad 111*a* is put on a place on the substrate 110 which is more remote from the connector 170.

The connector 170 includes the pin 171*a* which is provided corresponding to the pad on the substrate 110 that the ink tank 11 includes. The pin 171*a* serves to inform the user that the ink tank 11 has been mounted into the holder 161. The pins 171*b* to 171*d* serve to transmit various kinds of information such as the ink residual amount in the ink tank 11. The pins 171*a* to 171*d* are the same as one another in length. Therefore, each of the pads 111*b* to 111*d* is electrically connected with each of the pins 171 *b* to 171*d* and the pad 111*a* is not electrically connected with the pin 171*a* because of the crank-like bent shape of the substrate 110.

Next, FIG. 9C illustrates the substrate 120 and the connector 180 which are in the same mounting process as that of the state in FIGS. 6E and 6F in the first embodiment. The substrate 120 includes pads 121*a* to 121*d* provided thereon. The pad 121*a* serves to inform the user that the ink tank 12 has been mounted into the holder 162. The pads 121*b* to 121*d* serve to transmit various kinds of information such as the ink residual amount in the tank 12 and so on. The substrate 120 is bent and the pad 121*a* is put on a place on the substrate 120 which is more remote from the connector 180.

The connector 180 includes pins 181*a* to 181*d* which are provided corresponding to the pads on the substrate 120 that the ink tank 12 includes. The pin 181*a* serves to inform the user that the ink tank 12 has been mounted into the holder 162. The pins 181*b* to 181*d* serve to transmit various kinds of information such as the ink residual amount in the ink tank 12. Although the pins 181*b* to 181*d* are the same as one another in length, the pin 181*a* is made shorter than the pins 181*b* to 181*d*. Therefore, it is possible to make a difference between a timing at which each of the pads 121*b* to 121*d* is electrically connected with each of the pins 181*b* to 181*d* and a timing at which the pad 121*a* is electrically connected with the pin 181*a* by bending the substrate 120 and making the length of the pin 181*a* short as mentioned above.

Next, FIG. 9D illustrates the substrate 130 and the connector 190 which are in the same mounting process as that of the case in FIGS. 6E and 6F of the first embodiment. The substrate 130 includes pads 131*a* to 131*d* provided thereon. The pad 131*a* serves to inform the user that the ink tank 13 has been mounted into the holder 163. The pads 131*b* to 131*d* serve to transmit various kinds of information such as the ink residual amount in the ink tank 12. The substrate 130 is not parallel with the connector 190 and is arranged with a constant inclination relative to the connector 190. The pad 131*a* is placed on a place on the substrate 130 which is the most remote from the connector 190.

The connector 190 includes pins 191*a* to 191*d* which are provided corresponding to the pads on the substrate 130 that the ink tank 13 includes. The pin 191*a* serves to inform the user that the ink tank 13 has been mounted into the holder 163. The pins 191*b* to 191*d* serve to transmit various kinds of information such as the ink residual amount in the ink tank 13. The pins 191*b* to 191*d* are made different from one another in length in accordance with the above-mentioned inclination of the substrate 130 such that conduction timings thereof are made the same as one another. The pin 191*a* is made shorter than the pins 191*b* to 191*d* such that the pin 191*a* is made conductive later than the pins 191*b* to 191*d* in timing. Therefore, it is possible to make a difference between a timing at which each of the pads 131*b* to 131*d* is electrically connected with each of the pins 191*b* to 191*d* and a timing at which the pad 131*a* is electrically connected with the pin 191*a*, by inclining the substrate 130 and making the length of the pin 191*a* short as mentioned above.

It is possible to make the electrode which serves to inform the user that the ink tank has been mounted into the holder conductive after the state where it is sure that the ink tank will be mechanically mounted into the holder has been established also by the above-mentioned configuration in FIGS. 9B to 9D similarly to the first embodiment. Therefore, it is possible to prevent the user from stopping the mounting operation hastily in the state where mounting of the ink tank into the holder is not yet sure by informing the user that the state where it is sure that the ink tank will be mechanically mounted into the holder has been established, by making the light emitting unit emit light in accordance with conduction and so on.

<Other Modified Examples>

Although in the embodiments described so far, the ink tank is configured to be mounted onto the inkjet printing head attached to the carriage which performs reciprocal movement in the inkjet printing device, the present invention is not limited to such a configuration. The present invention is also applicable also to a configuration that, for example, the ink tank is mounted into the holder which is included in the inkjet printing device and does not perform reciprocal movement and the ink is supplied to the inkjet printing head through a tube and so on.

In addition, although the inkjet printing head illustrated in FIG. 2 is of the system that the heat generation resistance element is provided in the liquid path which configures the nozzle and the ink is ejected by giving the pulse signal to the heat generation resistance element, the present invention is not limited to such a system and the present invention is also applicable to, for example, a system using a piezoelectric element which converts voltage to force.

Then, although in the embodiments described so far, description has been made on the configuration that the ink tank and the inkjet printing heads are separated from each other, an ink tank of a configuration that the function of the inkjet printing head has been added to the ink tank may be adopted.

In addition, although in the above-mentioned embodiments, mounting of the ink tank has been informed of from the ink tank directly to the user or via the inkjet printing device main body, it is also possible to inform the inkjet printing device and/or a host device of the inkjet printing device of mounting of the ink tank, if necessary.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-171697, filed Aug. 26, 2014, which is hereby incorporated by reference wherein in its entirety.

What is claimed is:

1. A liquid tank comprising:

a structure for attaching to a attaching unit of a liquid ejecting apparatus, wherein the attaching unit of the liquid ejecting apparatus includes an introducing portion, a locking portion and a first apparatus-side electrode, and wherein the structure of the liquid tank includes a supplying portion for joining to the introducing portion and an engaging portion to be engaged with the locking portion, the supplying portion being joined to the introducing portion at an attachment completion position where the engaging portion is engaged with the locking portion to supply a liquid which is contained in the liquid tank from the supplying portion to the liquid ejecting apparatus via the introducing portion;

a first tank-side electrode corresponding to the first apparatus-side electrode;

an informing unit; and a control unit configured to control the informing unit in accordance with a conduction state between the first apparatus-side electrode and the first tank-side electrode, wherein the liquid tank is configured such that the engaging portion is engaged with the locking portion by movement of the liquid tank relative to the attaching unit by force acting on a predetermined portion of the liquid tank, and the liquid tank is attached to the attaching unit at the attachment completion position, and in the movement, after the liquid tank has gone past the attachment completion position and the engaging portion has come into a state of being partially engaged with the locking portion, the conduction state between the first apparatus-side electrode and the first tank-side electrode shifts from a non-conductive state to a conductive state, and then the conduction state between the first apparatus-side electrode and the first tank-side electrode shifts from the conductive state to the non-conductive state.

2. The liquid tank according to claim 1, wherein the engaging portion includes a projection, the locking portion includes an opening, and in the movement, the projection enters the opening and one surface which forms the projection abuts on one surface which defines the opening, and thereby the locking portion is engaged with the engaging portion, and in the state where the engaging portion is partially engaged with the locking portion, at least part of the projection enters the opening.

3. The liquid tank according to claim 2, wherein the liquid tank includes a rod-like member, and the projection is provided on the rod-like member, and in the movement, the rod-like member deforms so as to approach a main body of the liquid tank on the basis of the force acting on the predetermined portion in a case where the projection abuts on a portion near the opening in the attaching unit.

4. The liquid tank according to claim 3, wherein an orientation of the one surface which forms the projection and defines the opening is different from an orientation of a trace along which the rod-like member moves in accordance with the movement of the liquid tank.

5. The liquid tank according to claim 1, wherein the attaching unit includes plural apparatus-side electrodes including the first apparatus-side electrode and at least one second apparatus-side electrode, the liquid tank includes plural tank-side electrodes including the first tank-side electrode and at least one second tank-side electrode, the plural tank-side electrodes corresponding to the plural apparatus-side electrodes, and the liquid tank is configured such that in a case where the liquid tank is fixed at the attachment completion position, the conduction state between the first apparatus-side electrode and the first tank-side electrode is a non-conductive state, and the conduction state between the second apparatus-side electrode and the second tank-side electrode is a conductive state, and exchange of information related to the liquid tank is performed between the liquid tank and the liquid ejecting apparatus via the conductive second apparatus-side and second tank-side electrodes.

6. The liquid tank according to claim 1, wherein the informing unit includes a light emitting element.

7. The liquid tank according to claim 1, wherein the attaching unit includes a second locking portion and the structure includes a second engaging portion to be engaged with the second locking portion of the attaching unit, and in the movement to the attachment completion position, the a second engaging portion is positioned on the second locking portion and the liquid tank is rotated about the second engaging portion by the force acting on the predetermined portion, and thereby the liquid tank is attached to the attaching unit.

8. A liquid ejecting apparatus, comprising:

an attaching unit configured to attach a liquid tank, the attaching unit including an introducing portion, a locking portion and a first apparatus-side electrode; and an ejecting portion configured to eject a liquid supplied from the liquid tank via the introducing portion, wherein the liquid tank comprises:

a structure for attaching to the attaching unit of the liquid ejecting apparatus, wherein the structure of the liquid tank includes a supplying portion for joining to the introducing portion and an engaging portion to be engaged with the locking portion, the supplying portion being joined to the introducing portion at an attachment completion position where the engaging portion is engaged with the locking portion to supply a liquid which is contained in the liquid tank from the supplying portion to the liquid ejecting apparatus via the introducing portion;

a first tank-side electrode corresponding to the first apparatus-side electrode;

an informing unit; and a control unit configured to control the informing unit in accordance with a conduction state between the first apparatus-side electrode and the first tank-side electrode, wherein the liquid tank is configured such that the engaging portion is engaged with the locking portion by movement of the liquid tank relative to the attaching unit by force acting on a predetermined portion of the liquid tank, and the liquid tank is attached to the attaching unit at the attachment completion position, and in the movement, after the liquid tank has gone past the attachment completion position and the engaging portion has come into a state of being partially engaged with the locking portion, the conduction state between the first apparatus-side electrode and the first tank-side electrode shifts from a non-conductive state to a conductive state, and then the conduction state between the first apparatus-side electrode and the first tank-side electrode shifts from the conductive state to the non-conductive state.

9. The liquid ejecting apparatus according to claim 8, wherein the liquid is ink and the ejecting portion is an inkjet printing head.

10. The liquid tank according to claim 5, wherein in the movement, before reaching the attachment completion position, each of the plural tank-side electrodes faces a corresponding one of the plural apparatus-side electrodes at separation distance, and the separation distance of the first tank-side electrode relative to the first apparatus-side electrode is more remote than the separation distance of the second tank-side electrode relative to the second apparatus-side electrode.

11. The liquid tank according to claim 1, wherein at the conductive state, the control unit controls the informing unit to give information, and then the conduction state between the first apparatus-side electrode and the first tank-side electrode shifts from the conductive state to the non-conductive state which corresponds to the attachment completion position.

12. The liquid ejecting apparatus according to claim 8, wherein at the conductive state, the control unit controls the informing unit to give information, and then the conduction state between the first apparatus-side electrode and the first tank-side electrode shifts from the conductive state to the non-conductive state which corresponds to the attachment completion position.

* * * * *